United States Patent [19]

Fibus

[11] 4,159,814

[45] Jul. 3, 1979

[54] FRAMING FOR SHELVES

[75] Inventor: C. Kenneth Fibus, Youngstown, Ohio

[73] Assignee: The Steel City Corporation, Youngstown, Ohio

[21] Appl. No.: 810,648

[22] Filed: Jun. 27, 1977

[51] Int. Cl.[2] ..... A47B 96/06

[52] U.S. Cl. ..... 248/243; 108/108; 108/110; 248/220.2; 248/241; 211/193

[58] Field of Search ..... 108/96–101, 108/107–111, 152; 211/187, 191, 193, 208; 248/243, 241, 220.2, 235, 247, 248

[56] References Cited

U.S. PATENT DOCUMENTS 2,788,902 4/1957 Nowicki ..... 248/243 X

FOREIGN PATENT DOCUMENTS 206057 10/1955 Australia ..... 108/108
1192691 10/1959 France ..... 108/109
464496 7/1935 United Kingdom ..... 108/111

*Primary Examiner*—James C. Mitchell
*Attorney, Agent, or Firm*—Webster B. Harpman

[57] ABSTRACT

Elongated slotted channel members and L-shaped corner pieces of registering cross sectional shapes may be assembled into various frames for supporting a plurality of shelves or the like.

2 Claims, 5 Drawing Figures

FRAMING FOR SHELVES

BACKGROUND OF THE INVENTION (1) Field of the Invention

This invention relates to frames, both free standing and attached to walls, for supporting shelves or the like.

(2) Description of the Prior Art

Prior frames for supporting shelves have incorporated elongated members and corner pieces such as may be seen in U.S. Pat. No. 3,229,790. The corner pieces extend horizontally between the elongated members and include diagonal sections. U.S. Pat. No. 1,427,248 shows angular corners formed on frame members and angular slotted corners are disclosed in U.S. Pat. No. 2,815,130 and its U.S. Pat. No. 24,535.

The present invention forms elongated slotted channel members with the base of the channel curving into outwardly and oppositely arranged continuous flanges which are themselves cross sectionally curved and which in turn curve into oppositely disposed outturned longitudinal edge flanges. L-shaped corner members of matching configurations register in the cross sectional configurations of the elongated slotted channel members. The framing for shelves disclosed herein is not anticipated by the structure of the prior art patents nor would the present structure be obvious to one having the prior art patents and their disclosures.

SUMMARY OF THE INVENTION

Framing for shelves incorporates novel shaped elongated slotted channel members and L-shaped corner pieces having similar cross sectional configurations so as to be registrable in the elongated slotted channel members. Frames formed of the elongated members and the L-shaped corner pieces are unusually rigid and form ideal supports for shelves and heavy loads.

DESCRIPTION OF THE PREFERRED EMBODIMENT

Figure 1:
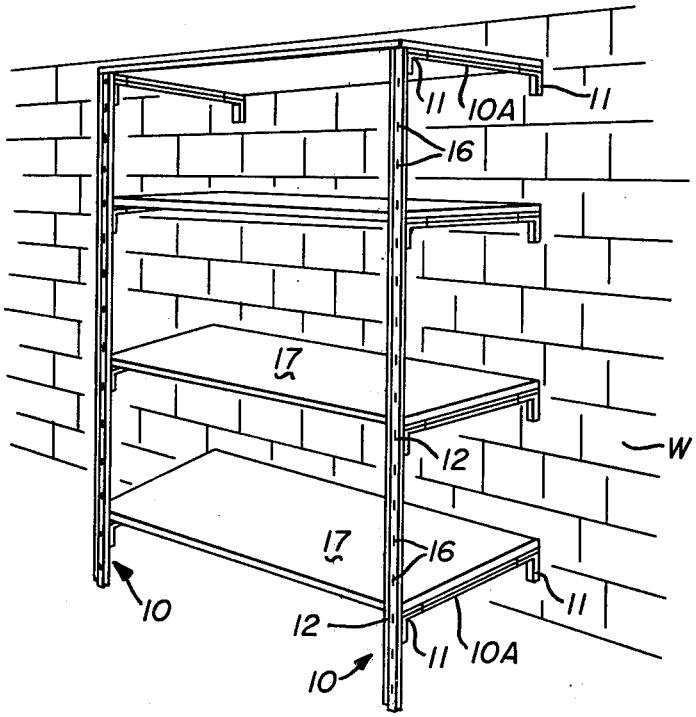
FIG. 1 is a perspective view of a frame for shelves embodying the present invention.
Figure 2:
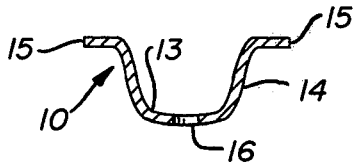
FIG. 2 is an enlarged horizontal section on line 2—2 of FIG. 4.
Figure 3:
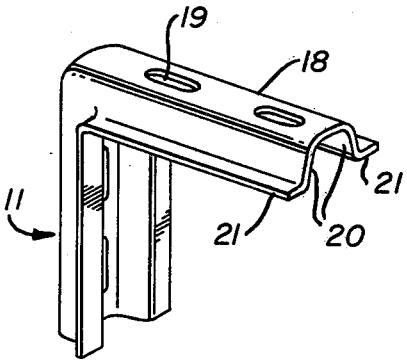
FIG. 3 is a perspective view of a corner piece as seen in FIG. 1.

In the forms of the invention disclosed herein, and referring now to FIGS. 1, 2 and 3 of the drawings, it will be seen that the framing for shelves comprises elongated slotted channel members 10 to which a plurality of L-shaped corner pieces 11 are secured by fasteners 12. The cross sectional shape of the elongated slotted channel members 10 is novel and by referring to the cross section comprising FIG. 2 of the drawings, it will be seen that the channel member 10 includes a transversely arcuate base portion 13 which curves into upwardly curving flanges 14 which are actually arcuate and which in turn curve into oppositely disposed outwardly extending substantially flat edge flanges 15 which are therefore offset outwardly and upwardly with respect to the base portion 13 and lie on parallel planes.

The base portion 13 has a plurality of longitudinally spaced slots 16 therein. The elongated slotted channel members 10 may be formed of relatively thin steel strips because their cross sectional configuration incorporating the curving base 13 and flanges 14 and the curves joining the same to the base portion 13 and the edge flanges 15 lend unusual rigidity thereto.

By referring again to FIG. 1 of the drawings, it will be seen that a pair of the elongated slotted channel members 10 have been positioned vertically in spaced relation to a wall W and a plurality of the corner pieces 11 attached thereto at longitudinally spaced intervals by fasteners 12 and a plurality of short sections 10A of the elongated channel members 10 have been secured to the horizontal portions of the corner pieces 11 and extend toward the wall W. Additional corner pieces 11 are secured to the opposite ends of the short sections 10A of the elongated slotted channel members 10 and then attached directly to the wall W by fasteners as will occur to those skilled in the art. A plurality of shelf boards 17 are then positioned on the short sections 10A and may be secured thereto if desired and a completed structurally strong frame including a plurality of vertically spaced shelves is thus formed.

By referring now to FIG. 3 of the drawings, a perspective view of one of the corner pieces 11 may be seen and it will be observed that it has a cross sectional configuration in both its vertical and horizontal sections which matches the cross sectional configuration of the elongated slotted channel member 10 hereinbefore described. In FIG. 3 of the drawings the L-shaped corner piece 11 will be seen to have a transversely arcuate longitudinally extending base portion 18 in which slots 19 are positioned in spaced relation to one another. Outwardly curving flanges 20 join the base portion 18 on curves of smaller radius and the arcuate sections of the flanges 20 and the flanges 20 curve gently into the oppositely disposed outwardly extending flat edge flanges 21.

The cross sectional configuration of each of the right angular portions of the corner pieces 11 is the same as the cross sectional configuration of the elongated slotted channel members 10 so that they nest one in the other and may be pulled into close association by fasteners such as bolts and nuts positioned therethrough. The matching configurations lend rigidity to the framing formed of the members herein disclosed and greatly increase the shear strength of the framing incorporating the respective members 10 and 11.

Figure 4:
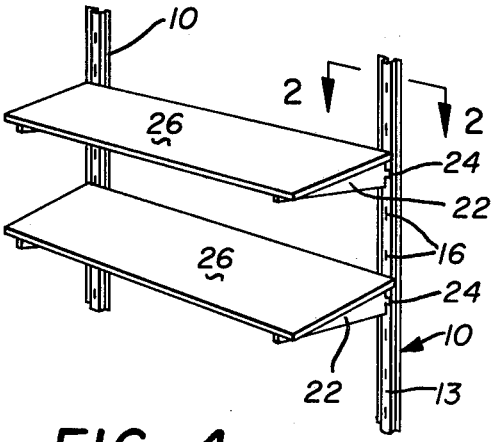
FIG. 4 is a perspective view of a framing modification utilizing the elongated slotted channel members of FIG. 1.
Figure 5:
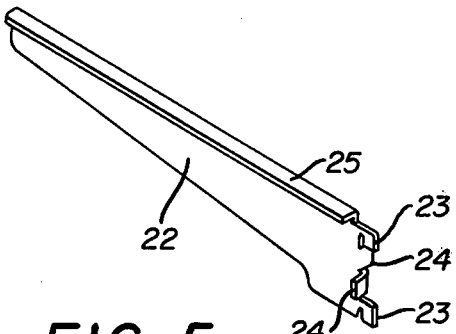
FIG. 5 is a perspective view of a framing member seen in the modification of FIG. 4.

Modifications of the framing for shelves disclosed herein will occur to those skilled in the art and by referring to FIGS. 4 and 5 one such modification may be seen wherein two sections of the elongated channel members 10 are affixed to a wall, not shown, in vertical spaced relation to one another and a plurality of flanged arms 22 having slotted tongues 23 on one of their ends engaged on the channel members 10 by the engagement of the slotted tongues 23 in the slots 16. The spacing of the slotted tongues 23 is the same as the spacing of the slots 16.

By referring to FIG. 5 of the drawings in particular, it will be seen that the end of the flanged arm 22 carrying the slotted tongues 23 also has outturned tabs 24 which engage the base 13 of the channel members 10 and hold the flanged arms 22 against pivoting motion based thereon. In FIG. 5 of the drawings, the flange on the arm 22 is indicated by the numeral 25 and in FIG. 4 of the drawings, boards 26 are shown positioned on the flanged arms 22 to form shelves.

Although but two embodiments of the present invention have been illustrated and described, it will be apparent to those skilled in the art that various changes and modifications may be made therein without departing from the spirit of the invention and having thus described my invention what I claim is:

1. Framing for shelves incorporating sections of elongated slotted channel members and apertured L-shaped corner pieces fastened thereto so as to form vertical and horizontal supports for a plurality of shelves, said elongated channel members having a transversely arcuate base portion and oppositely disposed longitudinally extending cross sectionally arcuate flanges joining said transversely arcuate base portion in continuously curving sections and oppositely coplanar outwardly extending continuous substantially flat edge flanges on said arcuate flanges, said L-shaped corner pieces each having an arcuate base portion and arcuate flanges which curve outwardly from said corner piece base portion to define a configuration corresponding to that configuration of said channel members mating with said channel members for intimate contact therewith in nesting relation with said corner piece base received in said channel member base so that said base members contact each other and corresponding ones of said flanges contact each other, said nested, correspondingly configured corner pieces and channel members adding rigidity and shear strength to the framing.

2. The framing for shelves set forth in claim 1 and wherein the portions of said arcuate flanges joining said flat edge flanges are curved.

* * * * *